US006976787B2

(12) United States Patent
Plourde

(10) Patent No.: US 6,976,787 B2
(45) Date of Patent: Dec. 20, 2005

(54) SLIDER-OPERATED ROCKING ZIPPER FOR RECLOSABLE PACKAGING

(75) Inventor: Eric Paul Plourde, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 143 days.

(21) Appl. No.: 10/121,315

(22) Filed: Apr. 11, 2002

(65) Prior Publication Data

US 2003/0194155 A1 Oct. 16, 2003

(51) Int. Cl.[7] ..... B65D 33/16
(52) U.S. Cl. ..... 383/64; 24/399; 24/416; 383/65
(58) Field of Search ..... 383/63, 64, 65, 383/61.3; 24/399, 400, 416

(56) References Cited

U.S. PATENT DOCUMENTS

| | | | | |
|---|---|---|---|---|
| 3,537,153 | A | 11/1970 | Ausnit | |
| 4,046,408 | A | 9/1977 | Ausnit | |
| 4,944,072 | A | 7/1990 | Robson | |
| 5,007,143 | A | 4/1991 | Herrington | |
| 5,017,021 | A | 5/1991 | Simonsen et al. | |
| 5,442,838 | A | 8/1995 | Richardson et al. | |
| 5,664,299 | A | 9/1997 | Porchia et al. | |
| 5,809,621 | A | 9/1998 | McCree et al. | |
| 5,971,155 | A | 10/1999 | Liang | |
| 6,014,795 | A | 1/2000 | McMahon et al. | |
| 6,030,122 | A | 2/2000 | Ramsey et al. | |
| 6,047,450 | A | 4/2000 | Machacek et al. | |
| 6,402,375 | B1 * | 6/2002 | Schreiter et al. | 383/64 |
| 6,581,253 | B2 * | 6/2003 | ErkenBrack | 24/428 |
| 6,612,002 | B1 * | 9/2003 | Savicki | 24/585.1 |

* cited by examiner

*Primary Examiner*—Joseph C. Merek
(74) *Attorney, Agent, or Firm*—Ostrager Chong Flaherty & Broitman P.C.

(57) ABSTRACT

A reclosable package has a flexible zipper and a slider. The zipper comprises first and second zipper parts having interlocking elements, first opposing portions on one side of the interlocking elements and second opposing portions on the other side of the interlocking elements. The slider has a top wall, first and second side walls connected to the top wall, an opening end, a closing end, and first and second camming means that have respective fixed positional relationships to the first and second side walls and that cam the first opposing portions of lengthwise sections of the first and second zipper parts located inside the slider in opposite directions during movement of the slider in an opening direction along the zipper, while the second opposing portions of the lengthwise sections of the first and second zipper parts located inside the slider do not move further away from each other during the slider movement in the opening direction.

10 Claims, 5 Drawing Sheets

SLIDER-OPERATED ROCKING ZIPPER FOR RECLOSABLE PACKAGING

BACKGROUND OF THE INVENTION

This invention generally relates to slider-operated flexible zippers for use in reclosable pouches, bags or other packages of the type in which perishable material, such as foodstuff, may be stored.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Other types of slider-operated zipper assemblies avoid the use of a separating finger. For example, U.S. Pat. No. 5,809,621 discloses a slider-operated zipper assembly wherein one zipper profile has a pair of handles that cooperate with the slider. As the slider is moved in an opening direction, the handles are squeezed together to disengage the profiles. In U.S. Pat. No. 5,442,838, a slider-operated zipper assembly is disclosed wherein the zipper profiles are engaged and disengaged in the course of a "rolling action". This "rolling action" is described as being achieved through cooperation between flanges on the profiles and shoulders which project inwardly from the arms of the slider. U.S. Pat. No. 6,047,450 discloses a zipper comprising a pair of mutually interlockable profiled structures. The first profiled structure comprises an interlocking element on a surface directed toward the second profiled structure and an integral base directed away from the second profiled structure. Likewise, the second profiled structure comprises an interlocking element on a surface directed toward the first profiled structure and an integral base directed away from the first profiled structure. Additionally, portions of the two profiled structures form a fulcrum about which the profiled structures may be pivoted out of engagement when lower edges of the bases are forced towards each other In the case of sliders having a separating finger or post, it is usually necessary to have the finger or post extend into the product side of the package. Since the zipper halves are relatively rigid, they do not conform to the shape of the post and a gap is left between the post and the point where the zipper halves are fully mated. This gap creates a potential for liquid and gas leakage from or into the package. From this standpoint, sliders without separating fingers or posts are an improvement.

There is a need for alternative designs of slider-operated zipper assemblies wherein a separating finger or post is not employed.

BRIEF DESCRIPTION OF THE INVENTION

The invention is directed to a slider-zipper assembly in which the slider cams the zipper open by spreading opposing portions of the zipper parts lying on one side of the interlocking elements, while the opposing portions of the zipper parts on the other side of the interlocking elements do not move away from and preferably contact each other.

One aspect of the invention is an assembly comprising a flexible zipper and a slider mounted to the zipper. The zipper comprises a first zipper part comprising a first interlockable element, a first portion extending on one side of the first interlockable element, and a second portion extending on the other side of the first interlockable element, and a second zipper part comprising a second interlockable element, a first portion extending on one side of the second interlockable element, and a second portion extending on the other side of the second interlockable element. The first and second interlockable elements are mutually interlockable. The first portions of the first and second zipper parts are mutually opposed. Similarly, the second portions of the first and second zipper parts are mutually opposed. The slider comprises first and second side walls, an opening end, a closing end, and first and second surfaces that have respective fixed positional relationships to the first and second side walls, are in contact with the first opposing portions of the first and second zipper parts respectively, and are divergent in a closing direction from the closing end to the opening end of the slider. The first opposing portions of lengthwise sections of the first and second zipper parts located inside the slider move further away from each other as the slider is moved in an opening direction along the zipper, while the second opposing portions of the lengthwise sections of the first and second zipper parts located inside the slider do not move further away from each other during the slider movement in the opening direction.

Another aspect of the invention is an assembly comprising a flexible zipper and a slider mounted to the zipper. The zipper comprises a first zipper part comprising a first interlockable element, a first portion extending on one side of the first interlockable element, and a second portion extending on the other side of the first interlockable element, and a second zipper part comprising a second interlockable element, a first portion extending on one side of the second interlockable element, and a second portion extending on the other side of the second interlockable element. The first and second interlockable elements are mutually interlockable. The first portions of the first and second zipper parts are mutually opposed. Similarly, the second portions of the first and second zipper parts are mutually opposed. The slider comprises first and second side walls, an opening end, a closing end, and first and second camming means that have respective fixed positional relationships to the first and second side walls and that cam the first opposing portions of lengthwise sections of the first and second zipper parts located inside the slider in opposite directions during movement of the slider in an opening direction along the zipper, while the second opposing portions of the lengthwise sections of the first and second zipper parts located inside the slider do not move further away from each other during the slider movement in the opening direction.

A further aspect of the invention is a reclosable package comprising a receptacle, a flexible zipper joined to said receptacle, and a slider mounted to said zipper. The zipper has a structure in accordance with one of the aspects previously described. Likewise the slider has structure and function in accordance with one of the aspects previously described.

Yet another aspect of the invention is a zipper comprising first and second zipper parts, wherein the first zipper part comprises a profiled rib on a side confronting the second zipper part and a first profiled groove on a side facing outward, and the second zipper part comprises a second profiled groove on a side confronting the first zipper part and a third profiled groove on a side facing outward, the profiled rib being interlocked with the second profiled groove. The first and third profiled grooves are located at a first elevation and the second profiled groove is located at a second elevation different than the first elevation when the first and second zipper parts are interlocked.

A further aspect of the invention is a zipper comprising first and second zipper parts, wherein the first zipper part comprises a first profiled rib on a side confronting the second zipper part and a second profiled rib on a side facing outward, and the second zipper part comprises a profiled groove on a side confronting the first zipper part and a third profiled rib on a side facing outward, the first profiled rib being interlocked with the profiled groove. The second and third profiled ribs are located at a first elevation and the first profiled rib is located at a second elevation different than the first elevation when the first and second zipper parts are interlocked.

Another aspect of the invention is a slider comprising a top wall, first and second side walls connected to the top wall and extending from an opening end to a closing end, and first and second profiled ribs respectively connected to and projecting from the interior surfaces of the first and second side walls. Each of the first and second profiled ribs comprises a respective enlarged head. The heads of the profiled ribs are divergent along at least a portion of the length of the slider in a direction from the opening end to the closing end.

An additional aspect of the invention is a slider comprising a top wall, first and second side walls connected to the top wall and extending from an opening end to a closing end, first and second bottom walls respectively connected to the first and second side walls and projecting generally inward, and a first and second projections respectively connected to opposing ends of the first and second bottom walls and projecting generally toward the top wall. The first and second projections are divergent along at least a portion of the length of the slider in a direction from the opening end to the closing end.

Other aspects of the invention are disclosed and claimed below.

BRIEF DESCRIPTION OF THE DRAWINGS

FIG. 2 shows the closing end of the slider (in dashed lines) and the closed zipper (in solid lines); FIG. 3 shows the opening end of the same slider (in dashed lines) and the opened zipper (in solid lines). [To facilitate the reader's understanding, the relationship of the male and female profiles have not been reversed in the second view. This is also true for FIGS. 4 and 5 and FIGS. 6 and 7.]

FIG. 4 shows the closing end of the slider (in dashed lines) and the closed zipper (in solid lines); FIG. 5 shows the opening end of the same slider (in dashed lines) and the opened zipper (in solid lines).

FIG. 6 shows the closing end of the slider (in dashed lines) and the closed zipper (in solid lines); FIG. 7 shows the opening end of the same slider (in dashed lines) and the opened zipper (in solid lines).

FIG. 8 shows the closing end of the slider (in dashed lines) and the closed zipper (in solid lines).

DETAILED DESCRIPTION OF THE INVENTION

Figure 1:
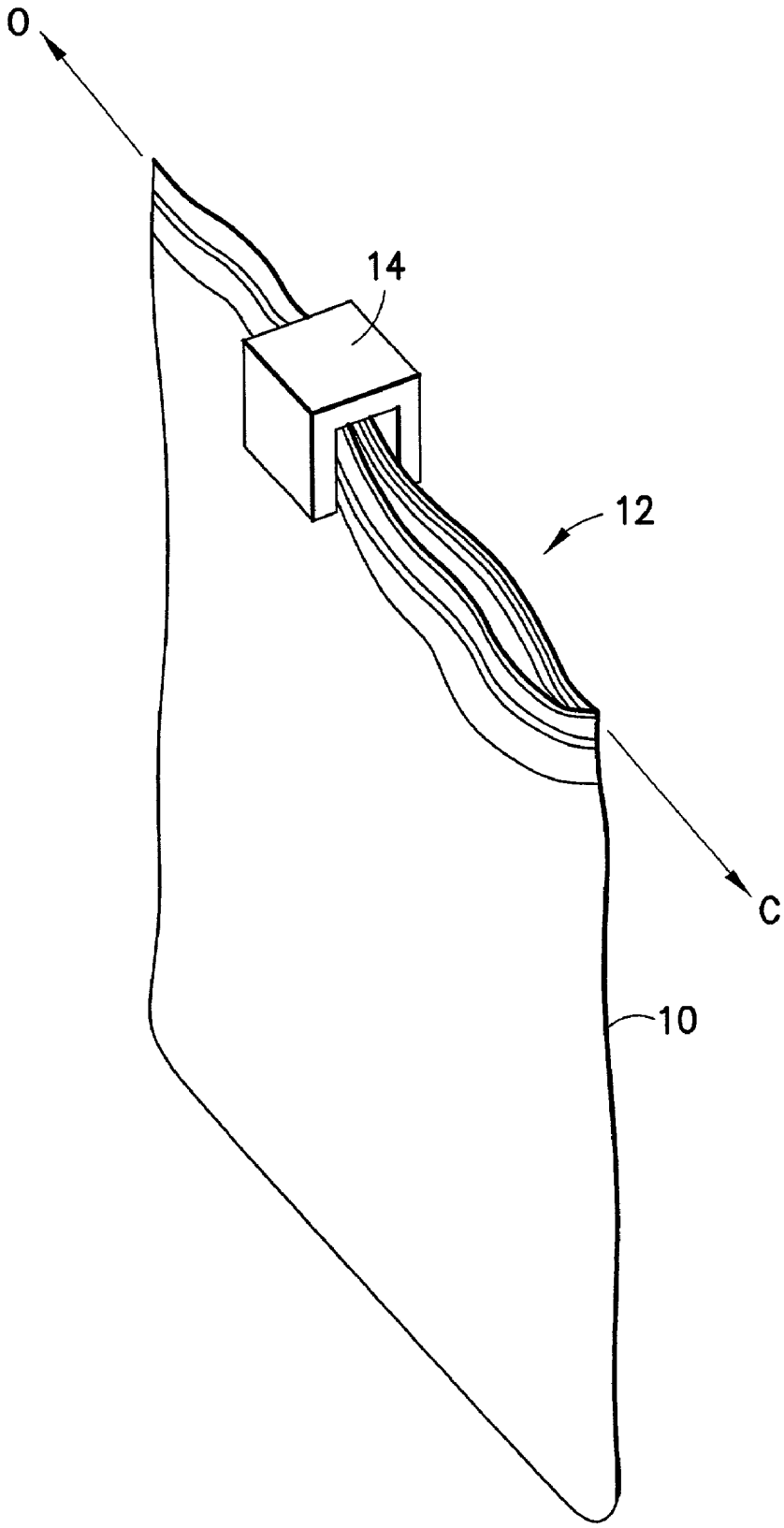
FIG. 1 is a schematic showing an isometric view of a reclosable package having a slider-operated flexible zipper.

Reference will now be made to the drawings, in which similar elements in different drawings bear the same reference numerals. A reclosable bag 10 having a flexible plastic zipper 12 operated by manipulation of a slider 14 is shown in FIG. 1. It should be understood that the slider-zipper assemblies disclosed herein can be installed in a reclosable bag of the type shown in FIG. 1 or other types of reclosable packages having different structures.

Still referring to FIG. 1, the bag 10 may be made from any suitable sheet material or plastic film and comprises opposite wall panels, which may be secured together at opposite side edges of the bag by seams (not shown). The opposing bottoms of the wall panels may be joined, for example, by means of a heat seal made in conventional fashion, e.g., by application of heat and pressure or ultrasonic energy. Typically, however, the bottom of the package is formed by a fold in the original packaging film. Optionally, the bag may be provided with side gussets having respective junctures with the front and rear wall panels. In the latter case, the bag may also be provided with a bottom panel having respective junctures with the front and rear wall panels and with the side gussets.

At its top end, the bag 10 has an openable mouth, on the inside of which is an extruded plastic zipper 12. The zipper 12 comprises a pair of interlockable fastener strips or zipper halves. The profiles of the zipper halves may take any form. For example, the zipper may comprise interlocking rib and groove elements or alternating hook-shaped closure elements. The preferred zipper material is polyethylene.

The front and rear bag wall panels are respectively sealed to the zipper halves 16 and 18 by heat fusion or welding. Alternatively, the interlockable zipper halves can be attached to the wall panels by adhesive or bonding strips or the zipper profiles can be extruded integrally with the bag material. For the purpose of joinder, each zipper half may be provided with a respective extension flange, to which an upper portion of the respective bag wall panel is fused or welded. The walls of the bag may be formed of various types of thermoplastic material, such as low-density polyethylene, substantially linear copolymers of ethylene and a C3–8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

In zippered bags with sliders, as the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The slider for opening or closing the reclosable zipper is generally shaped so that the slider straddles the zipper profiles. The ends of the slider are open to allow the zipper to pass through. The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

A bag incorporating a zipper and a slider preferably includes means, such as end stops (not shown in FIG. 1), for preventing the slider from sliding off the end of the zipper when the slider reaches the closed or fully opened position. Such end stops perform dual functions, serving as stops to prevent the slider from going off the end of the zipper and also holding the two zipper profiles together to prevent the bag from opening in response to stresses applied to the profiles through normal use of the bag. The end stops may, for example, comprise stomped areas on the zipper profiles themselves, riveted end clamps, plastic end clips fused to the zipper, or any other suitable structure. The stomped end stops can be sections of the profiles that are fused together proximate to the open and closed slider positions such that the end stops are raised. Stomping can be carried out by, for example, applying heat and/or pressure or using ultrasonic methods.

The zipper halves preferably comprise interlocking rib and groove elements, which are well known in the art. Many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements. The rib and groove elements may be carefully formed of a soft flexible material in part thereof so that the contents of the package are in fact relatively hermetically sealed from the outside.

Figure 3:
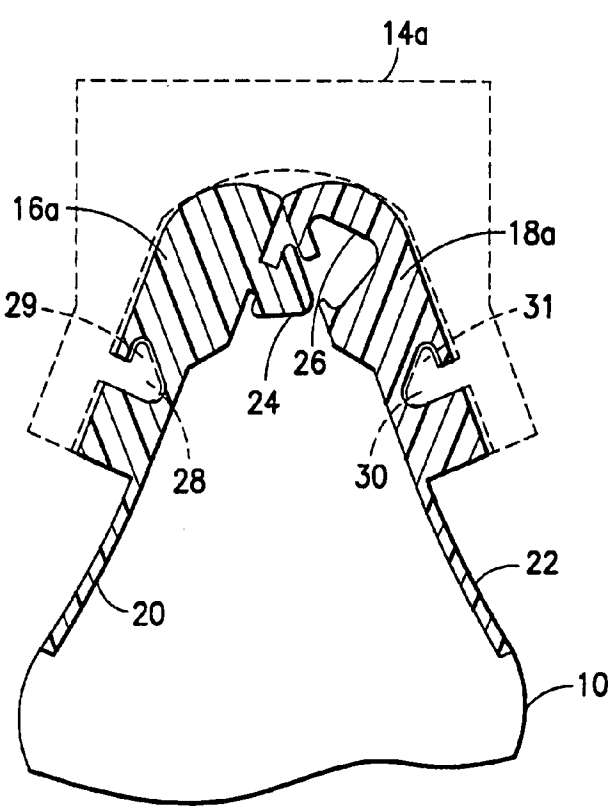
FIGS. 2 and 3 are schematics showing opposing end views of a slider-zipper assembly in accordance with a first embodiment of the invention.
Figure 2:
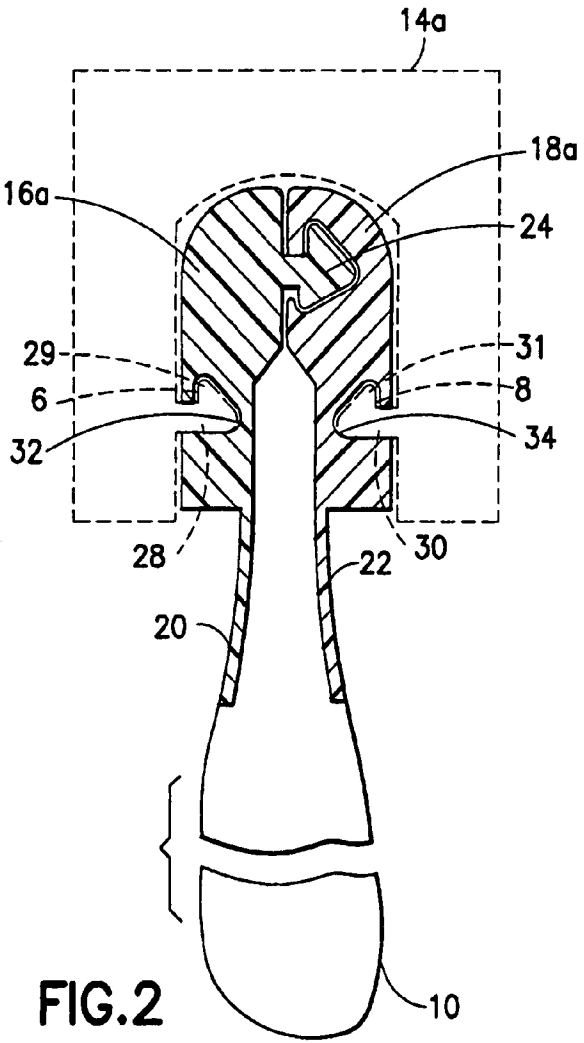

FIGS. 2 and 3 show cross-sectional views of a zipper in accordance with a first embodiment of the present invention. A slider 14*a* is shown in dashed lines. The closing end of the slider 14*a* is shown in FIG. 2; the opening end of the slider 14*a* is shown in FIG. 3. The zipper is shown in FIG. 2 in a closed state with zipper halves interlocked; the zipper is shown in FIG. 3 in an opened state with the zipper halves disengaged. The zipper comprises first and second fastener strips or zipper halves 16*a* and 18*a*. Each zipper half is preferably made by extruded thermoplastic material to form a strip with a constant profile. The first zipper half 16*a* comprises an interlockable profiled element 24 having a male profile and an extension flange 20; the second zipper half 18*a* comprises an interlockable profiled portion 26 (see FIG. 3) having a female profile and an extension flange 22. The front and rear wall panels of the bag 10 are respectively joined to the extension flanges 20 and 22. The male and female profiles may be configured and sized with tolerances sufficiently close to ensure a liquid-tight interlock between the profiles.

In accordance with the embodiment depicted in FIGS. 2 and 3, the lower portion of zipper half 16*a* is formed with a longitudinal groove 32 and the lower portion of the zipper half 18*a* is formed with a longitudinal groove 34. The grooves 32 and 34 face outward on opposite sides of the closed zipper. Each groove 32, 34 has a profile shaped to receive a respective rib 28, 30 extending inwardly from the side walls of the slider 14*a*. Each of ribs 28, 30 has a respective detent or hook 29, 31 projecting generally transverse to the rib at the rib's distal portion. The detents 29, 31, in cooperation with the form-fitting profiled grooves 32, 34, serve to latch the zipper halves 16*a*, 18*a* to the opposing side walls of the slider 14*a*. Preferably, the ribs 28 and 30 extend longitudinally the length of the slider.

The slider 14*a* is designed with side walls having portions that diverge in the direction from the closing end of the slider to the opening end of the slider. Similarly, the ribs 28 and 30 (and associated detents 29 and 31) diverge in the same direction. As a result of slider movement in the opening direction, the zipper halves are separated along those zipper segments traversed by the slider, or at least traversed by that portion of the slider which carries the diverging segments of ribs 28, 30. Because the lower portions of the zipper halves 16*a*, 18*a* are latched to the slider 14*a* by the diverging ribs 28, 30, during slider movement in the opening direction the lower portions of the zipper halves are pulled apart by the slider until the zipper profiles 24 and 26 are disengaged, i.e., no longer interlocked. The corners at the tops of the zipper halves are preferably rounded. These rounded corners are preferably in rocking contact during spreading open of the zipper by the slider.

The force that opens the zipper in the embodiment shown in FIGS. 2 and 3 is applied by those surfaces of the ribs 28 and 30 that face the opposing internal surfaces of the slider side walls, namely, the respective undersurfaces of 6, 8 of the detents 29, 31 of ribs 28, 30. A person skilled in the art will recognize that the ribs 28, 30 can have profiles different than those depicted in FIGS. 2 and 3, as long as the ribs have latching surfaces to abut and press against the zipper halves to spread them apart as the slider side walls diverge relative to the zipper. For example, ribs 28 and 30 could have detents on opposing sides of the stem, i.e., in the shape of an arrowhead.

Figure 5:
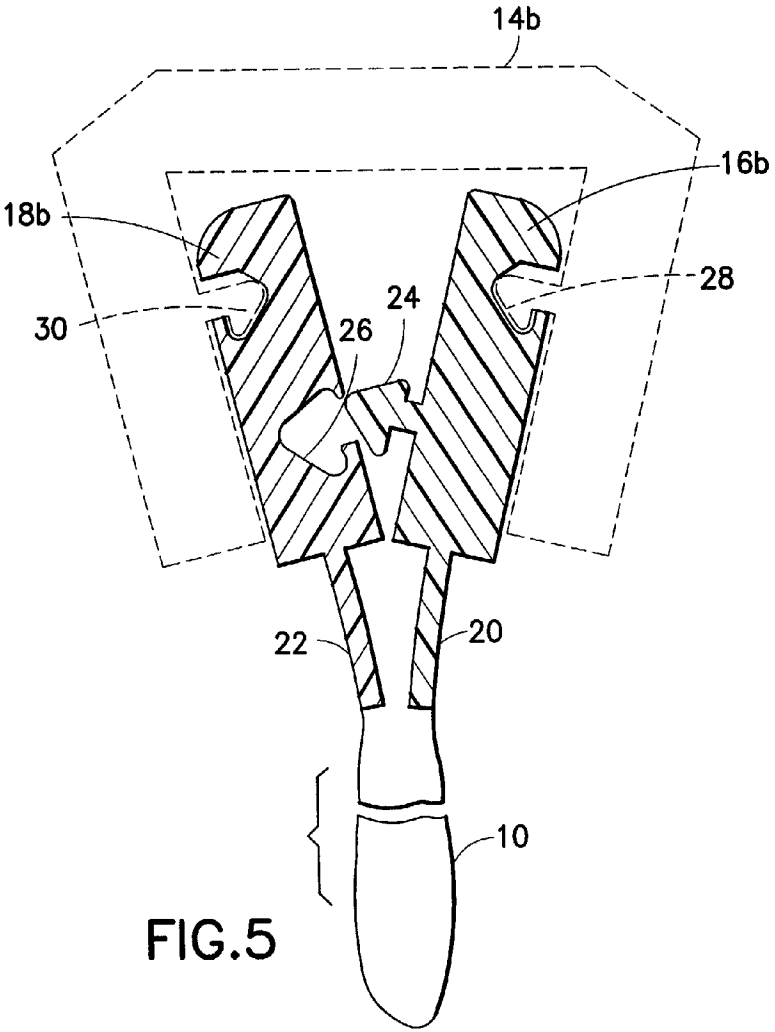
FIGS. 4 and 5 are schematics showing opposing end views of a slider-zipper assembly in accordance with a second embodiment of the invention.
Figure 4:
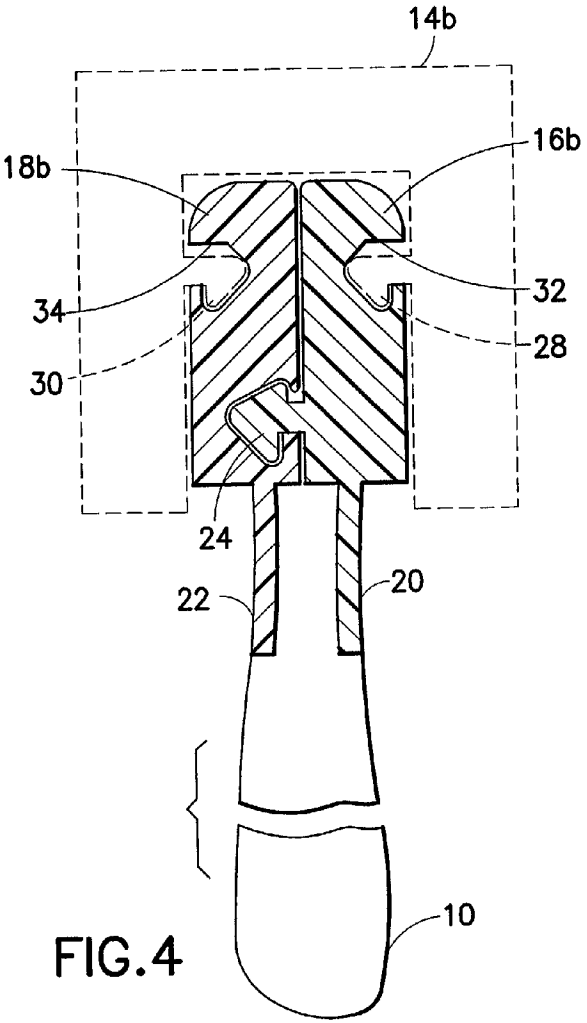

FIGS. 4 and 5 show cross-sectional views of a zipper in accordance with a second embodiment of the present invention. A slider 14*b* is shown in dashed lines. The closing end of the slider 14*b* is shown in FIG. 4; the opening end of the slider 14*b* is shown in FIG. 5. The zipper is shown in FIG. 4 in a closed state with zipper halves interlocked; the zipper is shown in FIG. 5 in an opened state with the zipper halves disengaged. The zipper comprises first and second fastener strips or zipper halves 16*b* and 18*b*. Again, each zipper half is preferably made by extruding thermoplastic material to form a strip with a constant profile. The first zipper half 16*b* comprises an interlockable profiled element 24 having a male profile and an extension flange 20; the second zipper half 18*b* comprises an interlockable profiled portion 26 (see FIG. 5) having a female profile and an extension flange 22. The front and rear wall panels of the bag 10 are respectively joined to the extension flanges 20 and 22. The male and female profiles may be configured and sized with tolerances sufficiently close to ensure a liquid-tight interlock between the profiles.

In accordance with the embodiment depicted in FIGS. 4 and 5, the upper portion of the zipper half 16*b* is formed with a longitudinal groove 32 and the upper portion of the zipper half 18*b* is formed with a longitudinal groove 34. The grooves 32 and 34 face outward on opposite sides of the closed zipper. Each groove 32, 34 has a profile shaped to receive a respective rib 28, 30 extending inwardly from the side walls of the slider 14*b*. Each of ribs 28, 30 has a detent or hook projecting generally transverse to the rib at the rib's distal portion. The detents, in cooperation with the form-fitting profiled grooves 32, 34, serve to latch the zipper halves 16*b*, 18*b* to the opposing side walls of the slider 14*b*. Preferably, the ribs 28 and 30 extend longitudinally the length of the slider. Although ribs 28 and 30 are shown as having a detent on one side, these ribs may instead be T-shaped with detents on both sides. The use of T-shaped ribs is desirable in the case where the slider is threaded onto the zipper from one end, in which case it would be preferable to have a rib profile that cannot be pulled out of the zipper profile during slider camming action. However, if the slider is side loaded and the slider ribs are pushed into the outside zipper grooves, then a rib profile with only one detent is preferred. The interlocking zipper elements should be designed to disengage from each other before the slider elements disengage from the zipper.

The slider 14*b* is designed with side walls having portions that diverge in the direction from the closing end of the slider to the opening end of the slider. Similarly, the ribs 28 and 30 diverge in the same direction. As a result of slider movement in the opening direction, the zipper halves are separated along those zipper segments traversed by the slider, or at least traversed by that portion of the slider which carries the diverging segments of ribs 28, 30. Because the zipper halves 16*b*, 18*b* are latched to the diverging ribs 28, 30 of the slider, during slider movement in the opening direction the upper portions of the zipper halves are pulled apart by the slider until the zipper profiles 24 and 26 are disengaged, i.e., no longer interlocked. The opposing corners at the bottoms of the zipper halves are preferably in rocking contact during spreading open of the zipper by the slider.

Figure 7:
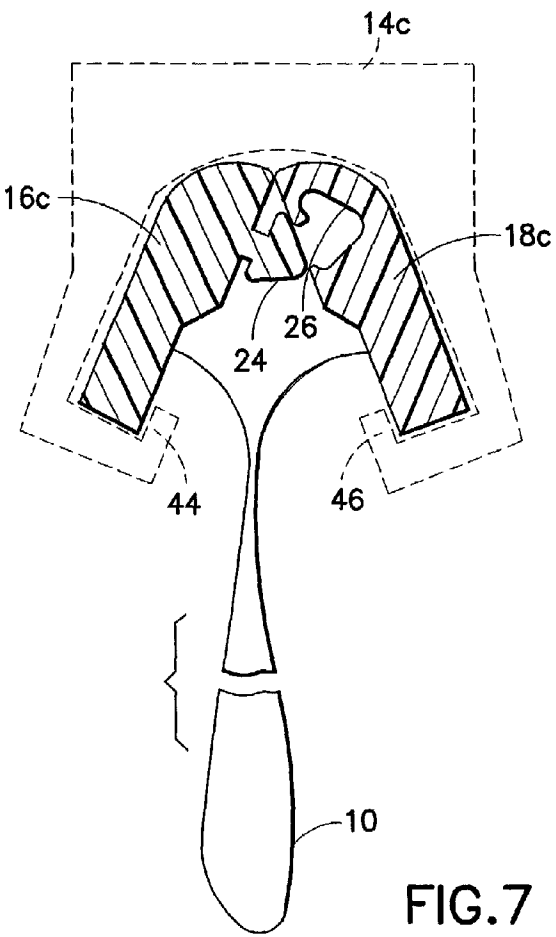
FIGS. 6 and 7 are schematics showing opposing end views of a slider-zipper assembly in accordance with a third embodiment of the invention.
Figure 6:
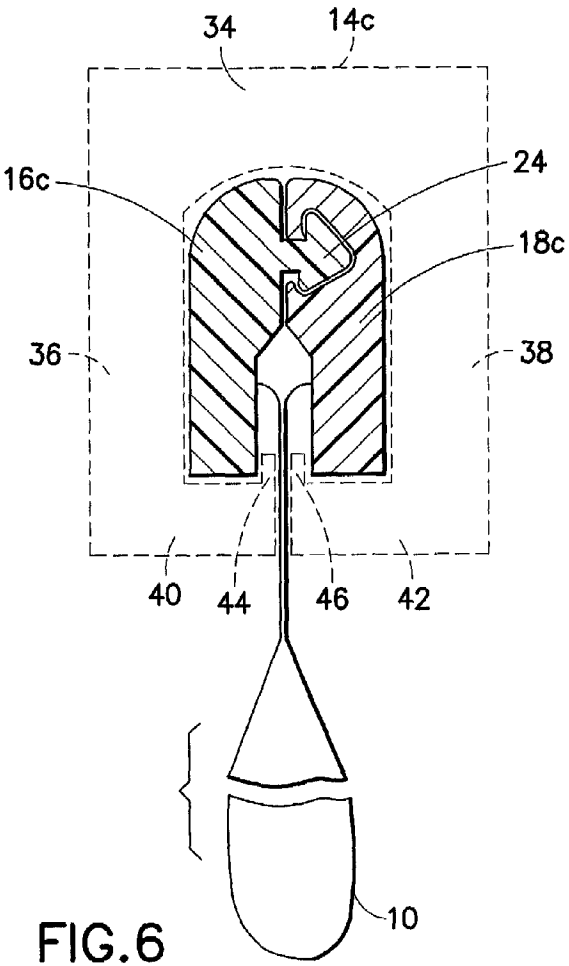

FIGS. 6 and 7 show cross-sectional views of a zipper in accordance with a third embodiment of the present invention. A slider 14*c* is shown in dashed lines. The closing end of the slider 14*c* is shown in FIG. 6; the opening end of the slider 14*c* is shown in FIG. 7. The zipper is shown in FIG. 6 in a closed state with zipper halves interlocked; the zipper is shown in FIG. 7 in an opened state with the zipper halves disengaged. The zipper comprises first and second fastener strips or zipper halves 16*c* and 18*c*. The first zipper half 16*c* comprises an interlockable profiled element 24 and no extension flange; the second zipper half 18*c* comprises an interlockable profiled portion 26 (see FIG. 7) having a female profile and no extension flange. The front and rear wall panels of the bag 10 are respectively joined to the zipper halves 16*c* and 18*c*. The bag and zipper could be extruded together, or the zipper could be extruded and then applied to the bag film. Alternatively, the zipper halves could be provided with extension flanges, to which the bag walls are joined.

In accordance with the embodiment depicted in FIGS. 6 and 7, the slider 14*c* comprises a top wall 34, a pair of side walls 36 and 38 connected to the top wall 34, a pair of bottom walls 40 and 42 respectively connected to the side walls 36 and 38, and a pair of upwardly directed projections 44 and 46 respectively connected to the bottom walls 40 and 42. In accordance with the third embodiment, the side wall 36 and opposing upward projection 44 define a recess in which a bottom portion of the zipper half 16*c* is seated with little play, while the side wall 38 and opposing upward projection 46 define a recess in which a bottom portion of the zipper half 18*c* is seated with little play. Preferably the slider has a monolithic construction. The preferred method of manufacture is injection molding.

As seen in FIG. 6, the zipper passes through the closing end of the slider with little play. In particular, the bottom portions of the zipper halves are effectively latched to the slider side walls by means of the upward projections 44 and 46. In accordance with the third embodiment, the side walls 36 and 38 diverge along the slider length in the direction from the closing end to the opening end of the slider. The side walls are shown with maximum divergence in FIG. 7. As the side walls diverge, the bottom walls 40, 42 and the upward projections 44, 46 maintain the same spatial relationship to the side walls. Since the upward projections 44 and 46 effectively latch the zipper halves 16*c* and 18*c* to the slider side walls, as the side walls diverge, so do the lower portions of the zipper halves. In other words, as the slider moves in the opening direction, the divergent projections 44 and 46 cause the lower portions of the zipper halves to spread apart, thereby prying open the zipper, as seen in FIG. 7. Again, the opposing top corners of the zipper halves 16*c*, 18*c* are preferably in abutment with each other as the lower portions of the zipper halves are pulled apart.

The force that opens the zipper in the embodiment shown in FIGS. 6 and 7 is applied by those surfaces of the projections 44, 46 that face the opposing internal surfaces of the slider side walls and that are in contact with the confronting surfaces of the zipper halves. A person skilled in the art will recognize that the projections can have profiles different than those depicted in FIGS. 6 and 7, as long as the projections have latching surfaces to abut and press against the zipper halves to spread them apart as the slider side walls diverge relative to the zipper.

Figure 8:
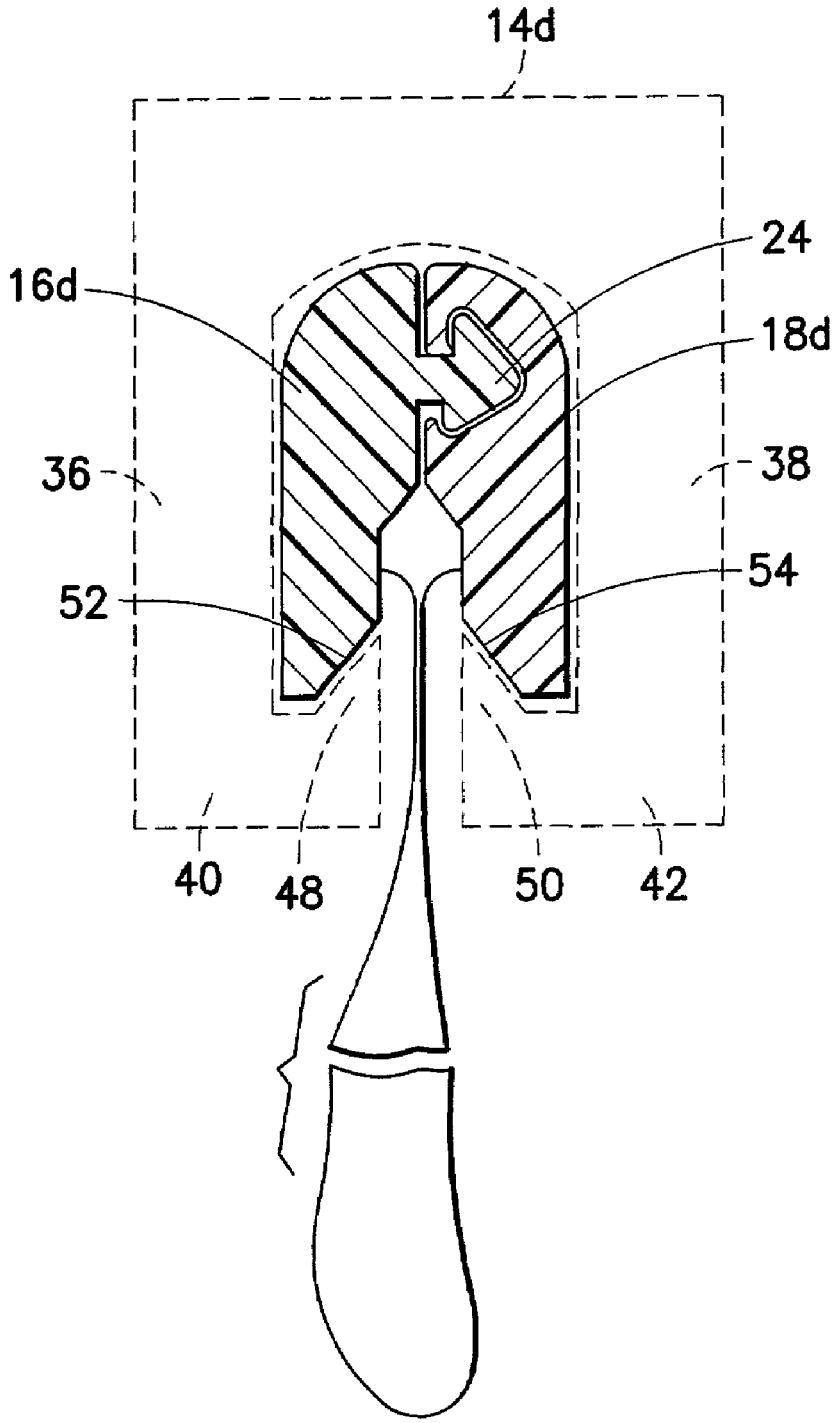
FIG. 8 is a schematic showing an end view of a slider-zipper assembly in accordance with a fourth embodiment of the invention.

One such different profile is shown in FIG. 8. In this fourth embodiment, the bottoms of the zipper halves have chamfers 52 and 54 respectively, while the projections 48 and 50 have triangular profiles instead of rectangular profiles. The chamfers and triangular projections are matched so that the projections again effectively latch the bottoms of the zipper halves to the slider side walls. Although the opening end of the slider 14*d* is not shown, it will be readily understood that the bottoms of the zipper halves 16*d* and 18*d* will be pulled apart when the side walls 36 and 38 diverge, thereby disengaging the male profile 24 from the female profile.

A person skilled in the art will further recognize that the bottom portions of the zipper halves may be provided with recesses that receive and interlock with respective form-fitting projections projecting upward from the bottom walls of the slider. The recesses in the bottoms of the zipper halves may comprise grooves that are V-shaped, U-shaped, etc. In accordance with a further alternative embodiment, the recesses could each have a female profile while the projections each have a male profile, or the recesses and projections could have profiles similar to those of ribs 28, 30 and grooves 32, 34 depicted in FIGS. 2 and 3, with the difference that the rib/groove coupling is made at the bottoms of the zipper halves as opposed to along the sides.

Although in each of the embodiments disclosed above, the female zipper half takes the form of a recess in a relatively thick strip, it is well-known to manufacture a female zipper member in the form of a pair of legs in a U-shaped arrangement projecting from a relatively thin strip, the legs having inwardly directed detents or hooks for latching behind and holding the detents or hooks of the inserted male profile. As a further alternative, both interlocking profiles may comprise alternating interleaved hook-shaped closure elements similar in profile instead of male/female profiles. Also, it will be obvious to a person skilled in the art that a rib may be continuous or may have discontinuities. In other words, as used herein, the term "rib"

encompasses both a continuous profiled rib member and a series of spaced profiled rib elements. The same is true for the term "projection."

While the invention has been described with reference to various embodiments, it will be understood by those skilled in the art that various changes may be made and equivalents may be substituted for elements thereof without departing from the scope of the invention. For example, although the first and second embodiments disclosed above are arranged so that the slider has diverging ribs or projections and the zipper profiles have form-fitting grooves, it would be equivalent to form the slider with diverging form-fitting profiled grooves, while the zipper halves have ribs or projections interlocked with the grooves on the slider. Also, it should be apparent to persons skilled in the art that the camming ribs and camming projections disclosed herein need not be continuously, but instead may be formed as a series of spaced apart rib sections. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "rib" means a rib that is continuous or comprises a series of spaced-apart rib sections. Similarly, as used in the claims, the term "projection" means a projection that is continuous or comprises a series of spaced-apart projecting sections

What is claimed is:

1. An assembly comprising a zipper and a slider mounted to said zipper, wherein:

said slider comprises first and second side walls, a first top portion that is connected to and bridges said first and second side walls to form an opening end, a second top portion that is connected to and bridges said first and second side walls to form a closing end, said first and second side walls depending downward from said first and second top portions to define a tunnel, a first bottom wall connected to said first side wall, a first upwardly directed projection connected to said first bottom wall, a second bottom wall connected to said second side wall, and a second upwardly directed projection connected to said second bottom wall; and said zipper comprises first and second zipper parts that pass through said tunnel, said first zipper part comprising a rib and said second zipper part comprising a groove in which said rib is inserted when said zipper is closed, said first zipper part further comprising a first uppermost portion having a section that is disposed between said rib and said first and second top portions of said slider, and a first lowermost portion having a section that is disposed between said first side wall and said first upwardly directed projection of said slider, and said second zipper part further comprising a second uppermost portion having a section that is disposed between said groove and said first and second top portions of said slider, and a second lowermost portion having a section that is disposed between said second side wall and said second upwardly directed projection of said slider, wherein said first and second upwardly directed projections are mutually divergent in a direction from said closing end to said opening end of said slider, whereby respective sections of said first and second zipper parts are pulled apart by said first and second upwardly directed projections of said slider as said slider is moved in an opening direction, resulting in disengagement of said rib of said first zipper part from said groove in said second zipper part while said first and second uppermost portions of said respective sections of said first and second zipper parts contact each other.

2. The assembly as recited in claim 1, further comprising a first wall of a receptacle having a portion joined to said first zipper part, and a second wall of said receptacle having a portion joined to said second zipper part.

3. An assembly comprising a zipper and a slider mounted to said zipper, wherein:

said slider comprises first and second side walls, a first top portion that is connected to and bridges said first and second side walls to form an opening end, a second top portion that is connected to and bridges said first and second side walls to form a closing end, said first and second side walls depending downward from said first and second top portions to define a tunnel, a first camming surface supported by said first side wall, and a second camming surface supported by said second side wall; and said zipper comprises first and second zipper parts that pass through said tunnel, said first zipper part comprising a rib and said second zipper part comprising a groove in which said rib is inserted when said zipper is closed, said first zipper part further comprising a first uppermost portion having a section that is disposed between said rib and said first and second top portions of said slider, and a first contact surface having a section that is in contact with said first camming surface of said slider, and said second zipper part further comprising a second uppermost portion having a section that is disposed between said groove and said first and second top portions of said slider, and a second contact surface having a section that is in contact with said second cramming surface of said slider, wherein said first and second camming surfaces are mutually divergent in a direction from said closing end to said opening end of said slider, whereby respective sections of said first and second zipper parts are pulled apart by said first and second camming surfaces of said slider bearing against said first and second contact surfaces respectively as said slider is moved in an opening direction, resulting in disengagement of said rib of said first zipper part from said groove in said second zipper part while said first and second uppermost portions of said respective sections of said first and second zipper parts contact each other.

4. The assembly as recited in claim 3, wherein said slider further comprises a first bottom wall connected to said first side wall, a first upwardly directed projection connected to said first bottom wall, a second bottom wall connected to said second side wall, and a second upwardly directed projection connected to said second bottom wall, said first camming surface being a surface of said first upwardly directed projection, and said second camming surface being a surface of said second upwardly directed projection.

5. The assembly as recited in claim 3, wherein said slider further comprises a first rib connected to said first side wall and projecting into said tunnel, and a second rib connected to said second side wall and projecting into said tunnel, said first camming surface being an undersurface of a detent of said first rib, and said second camming surface being an undersurface of a detent of said second rib.

6. The assembly as recited in claim 3, wherein said slider further comprises a first groove formed in said first side wall and opening into said tunnel, and a second groove formed in said second side wall and opening into said tunnel, said first camming surface being a surface inside said first groove, and said second camming surface being a surface inside said second groove.

7. The assembly as recited in claim 3, further comprising a first wall of a receptacle having a portion joined to said first zipper part, and a second wall of said receptacle having a portion joined to said second zipper part.

8. The assembly as recited in claim 3, wherein said first zipper part further comprises a first lowermost portion, and said second zipper part further comprises a second lowermost portion, further comprising a first extension flange having one end connected to said lowermost portion of said first zipper part, a first wall of a receptacle having a portion joined to said first extension flange, a second extension flange having one end connected to said lowermost portion of said second zipper part, and a second wall of said receptacle having a portion joined to said second extension flange.

9. The assembly as recited in claim 3, wherein said rib of said first zipper part is double hooked.

10. The assembly as recited in claim 5, wherein each of said first and second ribs of said slider is single hooked.

* * * * *